US005782302A

United States Patent [19]

Ringgenberg et al.

[11] Patent Number: 5,782,302

[45] Date of Patent: Jul. 21, 1998

[54] APPARATUS AND METHOD FOR LOADING FLUID INTO SUBTERRANEAN FORMATIONS

[76] Inventors: Paul D. Ringgenberg, 2101 Brentwood La., Carrollton, Tex. 75006; Neal G. Skinner, 1219 Indian Paint, Lewisville, Tex. 75076

[21] Appl. No.: 801,754

[22] Filed: Feb. 18, 1997

[51] Int. Cl.[6] ..... E21B 43/26

[52] U.S. Cl. ..... 166/305.1; 417/211

[58] Field of Search ..... 166/305.1; 74/88; 417/211, 415

[56] References Cited

U.S. PATENT DOCUMENTS

| | | | |
|---|---|---|---|
| 3,644,061 | 2/1972 | McFarlin | 417/203 |
| 3,693,604 | 9/1972 | Horan | 123/46 R |
| 4,685,534 | 8/1987 | Burstein et al. | 181/251 |
| 5,501,182 | 3/1996 | Kull et al. | 123/18 R |

*Primary Examiner*—Roger J. Schoeppel
*Attorney, Agent, or Firm*—William M. Imwalle; Paul I. Herman; Lawrence R. Youst

[57] ABSTRACT

An apparatus for loading fluid into subterranean formations includes a housing, a sleeve slidably disposed within the housing, a piston defining an interior volume, the piston slidably disposed within the sleeve and within the housing such that a fluid pressure within the interior volume causes the sleeve to oscillate relative to the housing and causes the piston to oscillate relative to the sleeve and the housing, and a pump which is operably associated with the piston such that the fluid pressure from the interior volume is intensified in the pump and injected into the formation as the piston oscillates relative to the housing.

40 Claims, 7 Drawing Sheets

APPARATUS AND METHOD FOR LOADING FLUID INTO SUBTERRANEAN FORMATIONS

TECHNICAL FIELD OF THE INVENTION

This invention relates, in general, to loading fluid into subterranean formations, and in particular to, an automatic downhole intensifier for improving the production of new or existing oil, gas or water wells by fracturing geological structures adjacent to the wellbore or by injecting stimulation fluid into subterranean formations or for injected fluids into disposal wells.

BACKGROUND OF THE INVENTION

Without limiting the scope of the present invention, its background is described with reference to fracturing geological structures adjacent to subterranean hydrocarbon formations, as an example.

During the life of a subterranean hydrocarbon formation, the production rate of hydrocarbons declines as hydrocarbons are produced from the formation. The rate of decline of a particular formation depends on the geologic type of the formation, for example, limestone, sandstone, chalk, etc., as well as physical structure of the formation, including its porosity and permeability. An Abnormal production decline may occur, however, when fines migrate into natural fissures in the formation or when skin formation occurs near the surface of the wellbore.

One method to alleviate this abnormal production decline is by using hydraulic fracturing techniques which stimulate subterranean formations in order to enhance the production of fluids therefrom. In a conventional hydraulic fractural procedure, fracturing fluid is pumped down the wellbore through a pipe string, generally drill pipe or tubing, into the fluid-bearing formation. The fracturing fluid is pumped in the formation under pressure sufficient to enlarge natural fissures in the formation and to open new fissures in the formation. Packers are typically positioned between the wellbore and the pipe string in order to direct and confine the fracturing fluid to a portion of the well which is to be fractured. Typical fracturing pressures range from about 1,000 psi to about 15,000 psi, depending upon the depth and the nature of the formation being fractured.

A variety of fluids may be used during hydraulic fracturing techniques including fresh water, gelled water, brine, gelled brine or liquid hydrocarbons such as gasoline, kerosene, diesel oil, crude oil and the like which are viscous or have gelling agents incorporated therein. Also, fracturing fluids commonly contain propping agents. A variety of propping agents may be used which include solid particulate materials such as sand, walnut shells, glass beads, metal pellets or plastics.

The propping agent flows into and remains in the fissures which are formed or enlarged during the fracturing operation. The propping agent operates to prevent the fissures from closing and to facilitate the flow of formation fluid through the fissures and into the wellbore, by providing a channel of much greater permeability than the formation itself. Thus, a propping agent should be selected to offer the greatest fissure permeability while possessing sufficient strength to prevent closure of the fissure.

Additionally, hydraulic fracturing operations may be conducted using a resin-coated particulate such as a resin-coated sand as the propping agent. Typical resin materials used as propping agents including epoxy resins and polyepoxide resins. Once in place in the formation, the resin-coated particular is allowed to harden whereby the resin-coated particulate material consolidates to form a hard, permeable mass. This type of resin-coated particulate is typically carried into the formation using an aqueous gelled carrier fluid.

The high pressure necessary to fracture a subterranean formation using conventional hydraulic fracturing techniques imposes substantial risks in terms of both economic cost and safety. Conventional hydraulic fracturing techniques require high pressure surface pumps and high pressure drill pipe or tubing. Additionally, the personnel in charge of operating the hydraulic fractural equipment are potentially exposed to high pressure hydraulic fracturing fluid if a failure occurs. Therefore, a need has arisen for an apparatus and method for stimulating a subterranean hydrocarbon formation by hydraulic fracturing which does not require the use of high pressure pipe strings or high pressure surface pumps. A need has also arisen for a fracturing apparatus and method which will not expose personnel to high pressure hydraulic fracturing fluids. Additionally, a need has arisen for such an apparatus and method which is economically viable and commercially feasible.

SUMMARY OF THE INVENTION

The present invention disclosed herein comprises an apparatus and method for stimulating fluid production from subterranean formations using an automatic downhole intensifier for pumping high pressure fluids into a subterranean formation. The automatic downhole intensifier is operated responsive to relatively low pressure fluids thereby not requiring high pressure surface pumps or high pressure drill pipe during operation and avoiding the presence of high pressure fluid on the surface.

The downhole intensifier of the present invention comprises a power section and a pump section which is operably associated with the power section so that the pump section is operated upon oscillatory motion of the power section after application of a relatively low fluid pressure to the power section.

In one embodiment, the power section comprises a housing, a sleeve slidably disposed within the housing, and a piston slidably disposed within the sleeve and within the housing such that the fluid pressure within the power section causes the sleeve to oscillate relative to the housing and causes the piston to oscillate relative to the sleeve and the housing.

In another embodiment, the power section comprises a housing, a mandrel slidably disposed within the housing, the mandrel having an axially extending hole and a piston slidably associated within the axially extending hole such that when a fluid pressure is applied to the power section, the mandrel oscillates axially relative to the housing and the piston oscillates axially relative to the mandrel and the housing.

In either embodiment, the pump section has at least one intake valve and at least one exhaust valve and the housing has at least one fluid passageway in communication with the annular area around the exterior of the intensifier.

In one embodiment of the pump section, the exhaust valve may be disposed below the intake valve such that the intake valve oscillates with the power section and the exhaust valve is fixed relative to the housing such that fluid is drawn through the intake valve from the interior of the pump section and fluid is pumped out of the intensifier through the exhaust valve and the fluid passageway into the subterranean formation.

In another embodiment, the pump section has first and second intake valves and first and second exhaust valves. The housing defines a chamber and has first and second fluid passageways in communication with the annular area around the exterior of the intensifier. The first and second intake valves respectively communicate with the interior of the pump section and the chamber. The first and second exhaust valves respectively communicate with the chamber and the first and second fluid passageways such that, fluid is pumped from the interior of the pump section into the chamber through the first and second intake valves and from the chamber into the subterranean formation through the first and second exhaust valves and the first and second fluid passageways.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
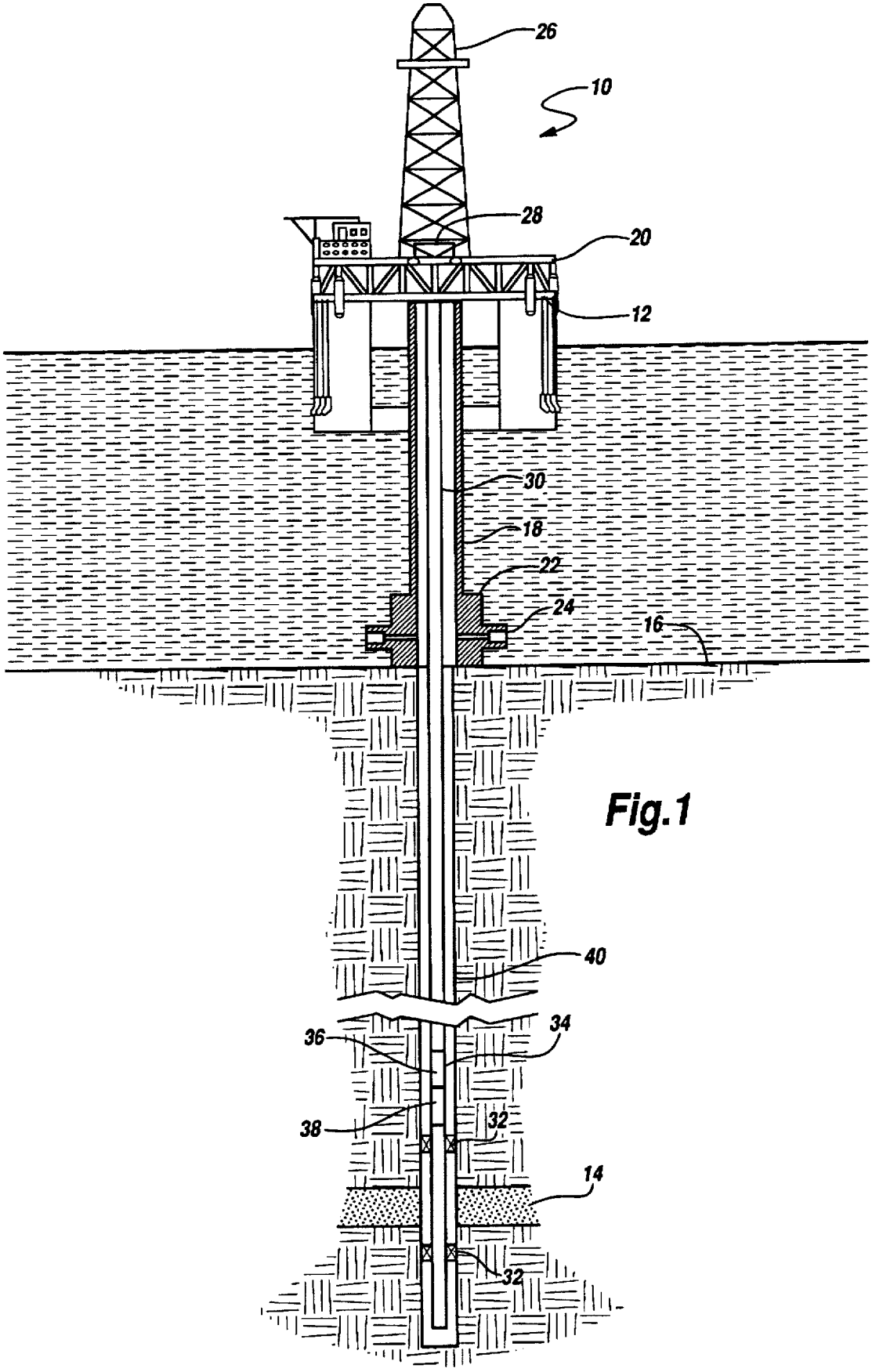
FIG. 1 is a schematic illustration of an offshore oil or gas drilling platform operating the automatic downhole intensifier of the present invention.

Referring to FIG. 1, an automatic downhole intensifier in use on an offshore oil or gas drilling platform is schematically illustrated and generally designated 10. A semisubmersible drilling platform 12 is centered over a submerged oil or gas formation 14 located below sea floor 16. A subsea conduit 18 extends from deck 20 of platform 12 to a well head installation 22 including blowout preventors 24. The platform 12 has a derrick 26 and a hoisting apparatus 28 for raising and lowering drill string 30. Drill string 30 may include seal assemblies 32 and automatic downhole intensifier 34. Intensifier 34 includes power section 36 and pump section 38.

During a hydraulic fracturing operation, drill string 30 is lowered into wellbore 40. Seal assemblies 32 are set to isolate formation 14. The tubing pressure inside drill string 30 is then elevated, causing the internal mechanisms within power section 36 to oscillate. This oscillation operates the internal mechanisms within pump section 38 which intensifies the fluid pressure from inside drill string 30 and allows intensifier 34 to inject fluids into formation 14 to hydraulically fracture formation 14. After fracturing the formation, the tubing pressure is reduced causing automatic downhole intensifier 34 to stop pumping.

It should be understood by one skilled in the art, that intensifier 34 of the present invention is not limited to use on drill string 30 as shown in FIG. 1. For example, pump section 38 of intensifier 34 may be inserted into drill string 30 on a probe. In fact, intensifier 34 of the present invention may be employed entirely on a probe using coiled tubing that is inserted into drill string 30 or into production tubing. In addition, intensifier 34 may be used during other well service operations. For example, intensifier 34 may be used to automatically pump fluid into formation 14 to acidize formation 14 or into fluid ports within drill string 30 to operate other downhole tools.

Even though the automatic downhole intensifier 34 has been referred to with reference a hydraulic fracturing operation, it should be understood by one skilled in the art that intensifier 34 of the present invention may be used during a variety of operations including, but not limited to, the injection of stimulation fluids into a new or existing oil, gas or waterwell as well as the injection of fluids into a disposal well. It should also be understood by one skilled in the art that intensifier 34 of the present invention is not limited to use with semisubmersible drilling platform 12 as shown in FIG. 1. Intensifier 34 is equally well-suited for use on conventional offshore platforms or onshore operations.

Figure 2A:
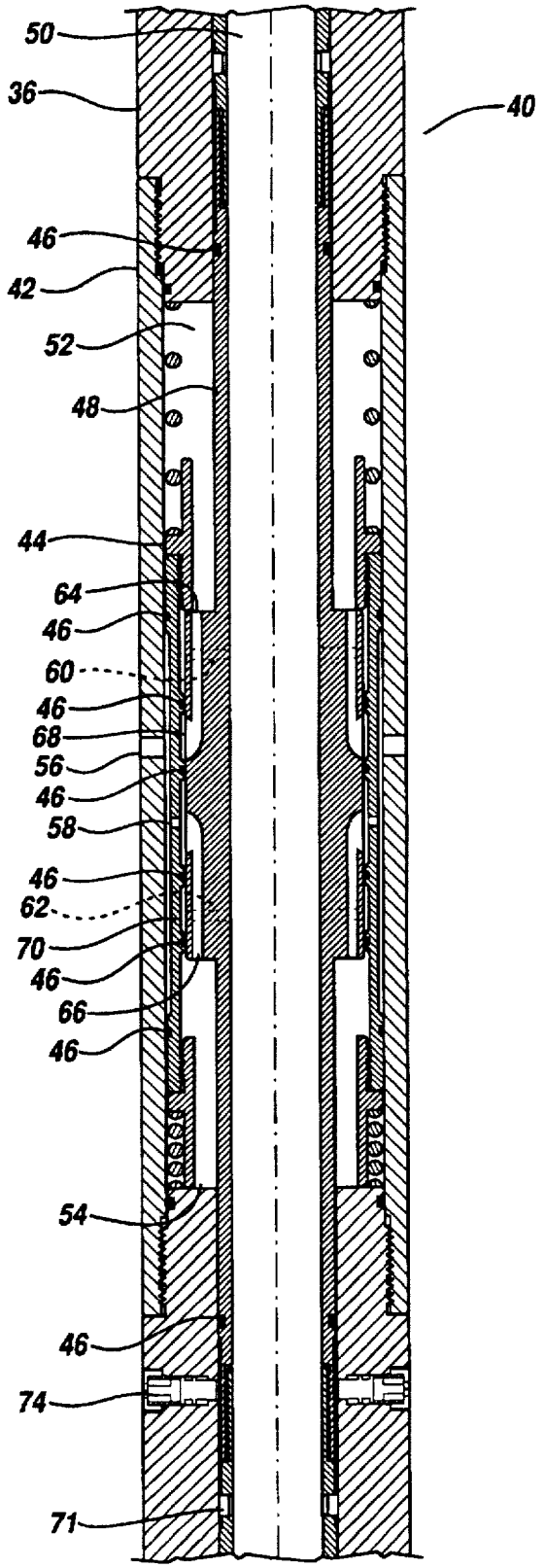
FIGS. 2A–2B are half-sectional views of an automatic downhole intensifier of the present invention.
Figure 2B:
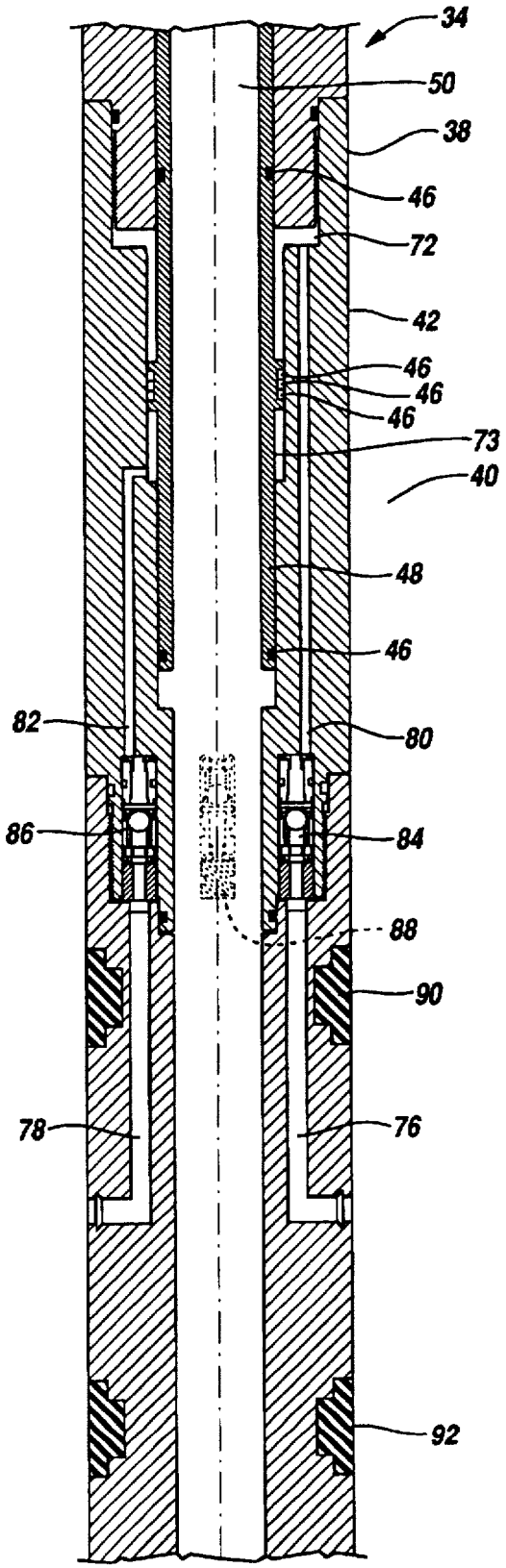

Referring to FIGS. 2A–2B, power section 36 and pump section 38 of automatic downhole intensifier 34 are depicted. Power section 36 comprises a housing 42 which may be threadably connected to drill string 30 at its upper and lower ends. Sleeve 44 is slidably disposed within housing 42. Annular seals 46, such as C-rings, are disposed between sleeve 44 and housing 42 to provide a seal therebetween. Piston 48 is slidably disposed within sleeve 44 and within housing 42. Annular seals 46 are disposed between piston 48 and sleeve 44 to provide a seal therebetween. Annular seals 46 are also disposed between piston 48 and housing 42 to provide a seal therebetween. Piston 48 defines an interior volume 50 which includes the centerline of drill string 30.

Between housing 42 and piston 48 is upper chamber 52 and lower chamber 54. Housing 42 defines fluid passageway 56 which is in communication with wellbore 40. Sleeve 44 defines fluid passageway 58 which is in communication with fluid passageway 56 of housing 42. Piston 48 defines upper radial fluid passageway 60 and lower radial fluid passageway 62. Upper radial fluid passageway 60 and lower radial fluid passageway 62 are in communication with interior volume 50. Piston 48 also defines upper axial fluid passageway 64 which is in communication with upper chamber 52 and lower axial fluid passageway 66 which is in communication with lower chamber 54. Between piston 48 and sleeve 44 is upper volume 68 and lower volume 70.

In operation, upper radial fluid passageway 60 is alternately in communication with upper chamber 52 and upper volume 68. Upper axial fluid passageway 64 is alternately in communication with upper volume 68 and fluid passageway 58 of sleeve 44. Lower radial fluid passageway 62 is alternately in communication with lower chamber 54 and lower volume 70. Lower axial fluid passageway 66 is alternately in communication with lower volume 70 and fluid passageway 58 of sleeve 44 as piston 48 oscillates with respect to housing 42. Piston 48 defines a groove 71 which accepts a plurality of locking members 74 which prevent relative axial movement between piston 48 and housing 42 when the tubing pressure inside interior volume 50 is less than a predetermined value. In operation, when the tubing pressure inside interior volume 50 exceeds the annulus pressure by a predetermined value, the bias force of the springs within locking members 74 is overcome, allowing locking members 74 to retract, thereby allowing piston 48 to move axially relative to housing 42.

Piston 48 and housing 42 further define chamber 72, 73. Housing 42 defines fluid passageways 76, 78 and fluid passageways 80, 82. Disposed within housing 42 and between fluid passageway 76 and fluid passageway 80 is exhaust valve 84. Disposed within housing 42 and between fluid passageway 78 and fluid passageway 82 is exhaust valve 86. Also, disposed within housing 42 is a pair of intake valves 88, 89 which are in communication with interior volume 50 and respectively in connection with fluid passageways 114, 120 (as best seen in FIG. 4B).

In operation, seal assembly 90 and seal assembly 92 are expanded to seal the area between wellbore 40 and housing 42 such that formation 14 is isolated from the rest of wellbore 40. The tubing pressure in interior volume 50 is increased causing piston 48 and sleeve 44 to oscillate axially relative to housing 42. As piston 48 travels downward relative to housing 42, fluid from interior volume 50 travels through intake valve 89 into chamber 72. At the same time, fluid in chamber 73 exits through exhaust valve 86 and fluid passageway 78 such that the fluid may enter formation 14. Similarly, as piston 48 travels upward relative to housing 32, fluid from interior volume 50 enters chamber 73 through intake valve 88. Fluid from within chamber 72 exits through fluid passageway 80, exhaust valve 84 and through passageway 76 into formation 14.

Figures 3A, 3B, 3C, 3D, 3E:
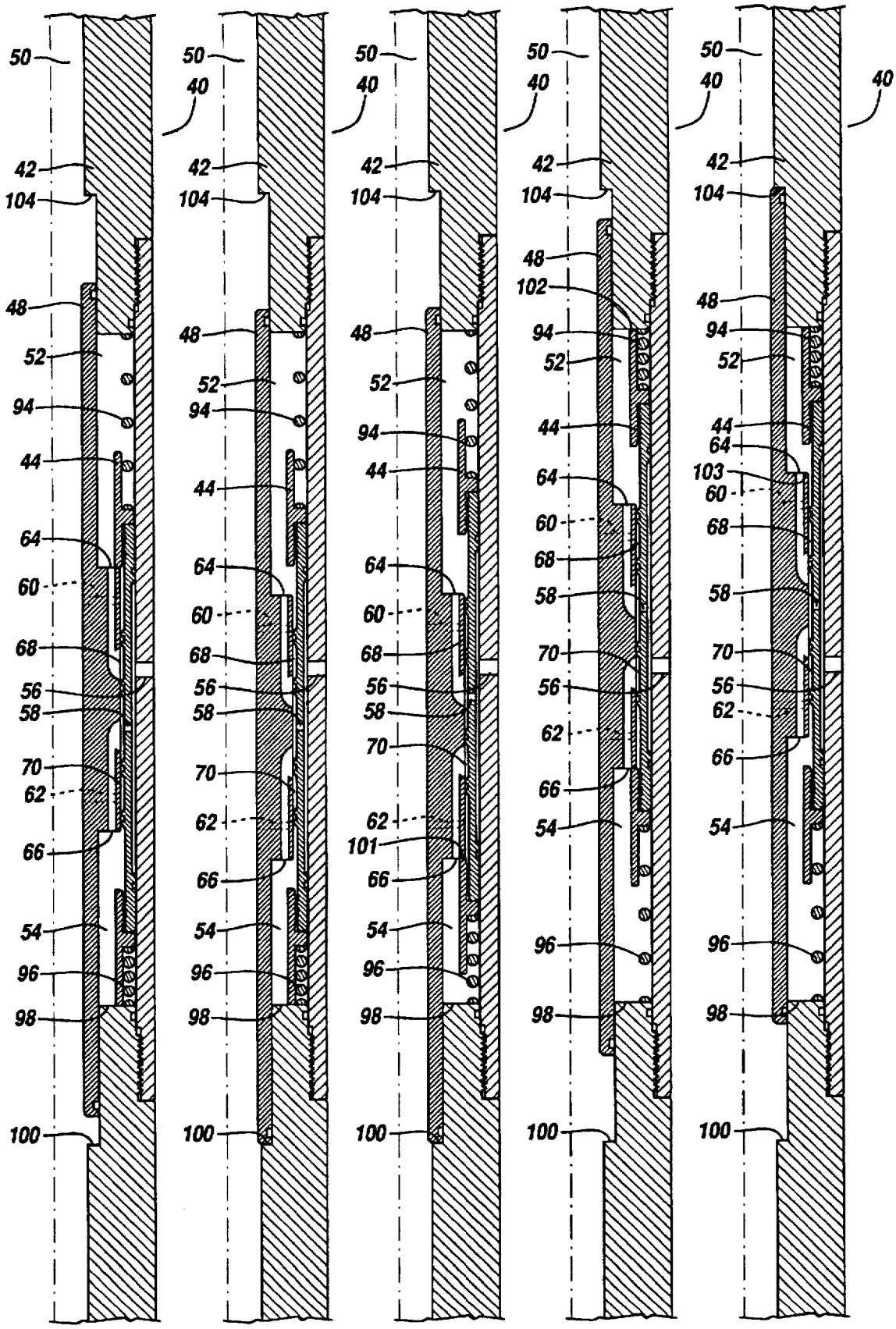
FIGS. 3A–3E are quarter-sectional views of the operation of a power section of an automatic downhole intensifier of the present invention.

In FIGS. 3A–3E, the operation of power section 36 of automatic downhole intensifier 34 is depicted. Fluid from interior volume 50 enters upper chamber 52 through upper radial fluid passageway 60. Fluid from lower chamber 54 enters wellbore 40 through lower axial fluid passageway 66, fluid passageway 58 of sleeve 44, and fluid passageway 56 of housing 42. The higher pressure fluid in chamber 52 downwardly urges sleeve 44 and piston 48 relative to housing 42. Upper coil spring 94 further urges sleeve 44 downward relative to housing 42. Sleeve 44 travels downward until it contacts shoulder 98 of housing 42 as depicted in FIG. 3A.

The higher pressure in chamber 52 continues to urge piston 48 downward relative to housing 42 and sleeve 44 after sleeve 44 contacts shoulder 98. Piston 48 continues to travel downward relative to sleeve 44 until radial fluid passageway 60 is in communication with upper volume 68, upper axial fluid passageway 64 is in communication with fluid passageway 58 of sleeve 44, lower radial fluid passageway 62 is in communication with lower chamber 54, and lower axial fluid passageway 66 is in communication with lower volume 70 completing the downward stroke of piston 48, equalizing the pressure in upper chamber 52 and lower chamber 54 and removing all hydraulic force on sleeve 44 as depicted in FIG. 3B.

Lower coil spring 96 upwardly urges sleeve 44 until sleeve 44 contacts shoulder 101 of piston 48 as depicted in FIG. 3C. Fluid from interior volume 50 enters lower chamber 54 through lower radial fluid passageway 62 while fluid from upper chamber 52 enters wellbore 40 through upper axial fluid passageway 64, fluid passageway 58 of sleeve 44, and fluid passageway 56 of housing 42. The higher pressure fluid in chamber 54 upwardly urges sleeve 44 and piston 48 relative to housing 42. Piston 48 and sleeve 44 travel upward together until sleeve 44 stops against shoulder 102 of housing 42 as depicted in FIG. 3D.

The higher pressure fluid in lower chamber 54 continues to urge piston 48 upward until upper radial fluid passageway 60 is in communication with upper chamber 54, upper axial fluid passageway 64 is in communication with upper volume 68, lower radial fluid passageway 62 is in communication with lower volume 70 and lower axial fluid passageway 66 is in communication with fluid passageway 58 of sleeve 44. This ends the upward stroke of piston 48 and allows the pressure in upper chamber 52 and lower chamber 54 to equalize and removes all hydraulic forces on sleeve 44, as depicted in FIG. 3E. Upper coil spring 94 downwardly urges sleeve 44 until sleeve 44 contacts shoulder 103, allowing fluid from interior volume 50 to enter upper chamber 52 and starting the downward cycle again.

Figure 4A:
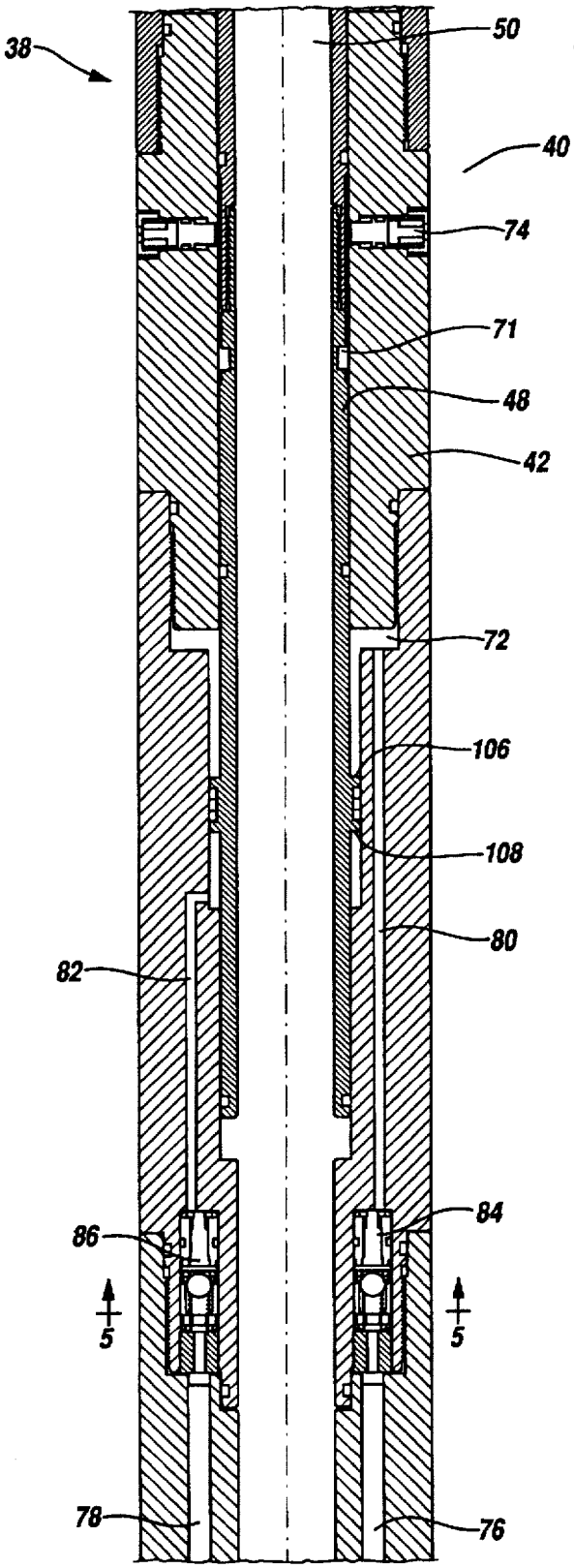
FIGS. 4A–4B are half-sectional views of a pump section of an automatic downhole intensifier of the present invention.
Figure 4B:
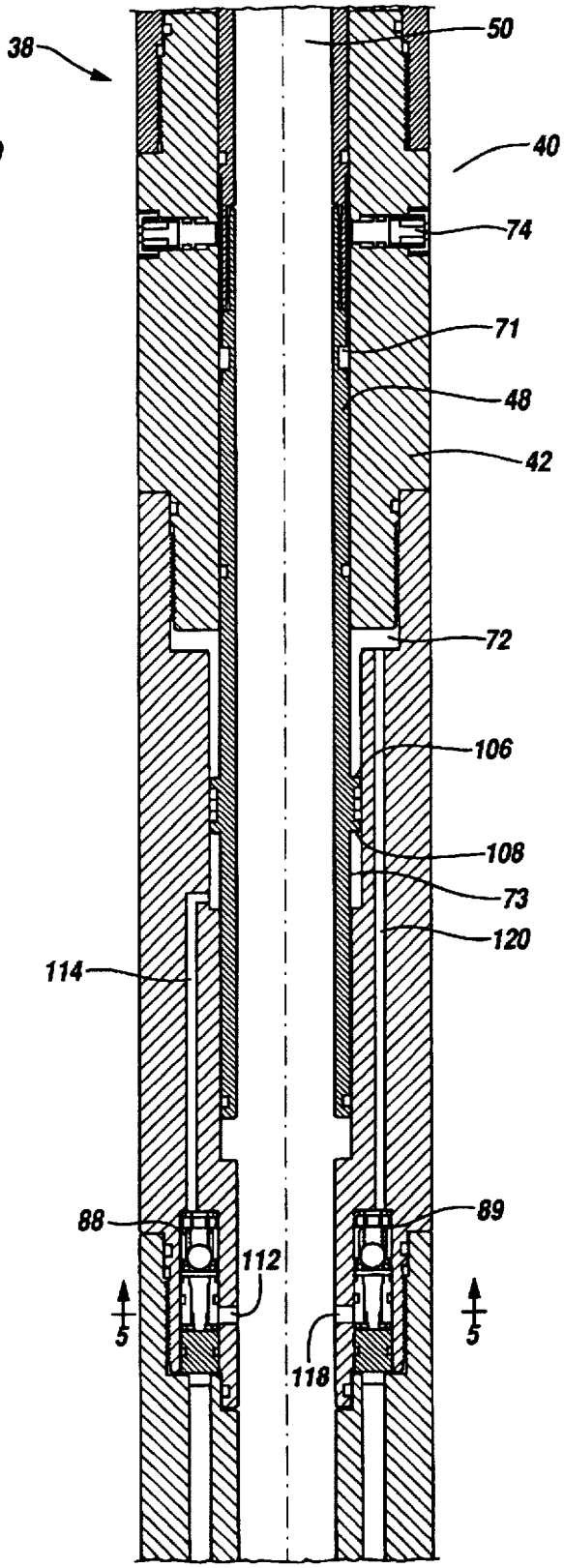
Figure 5:
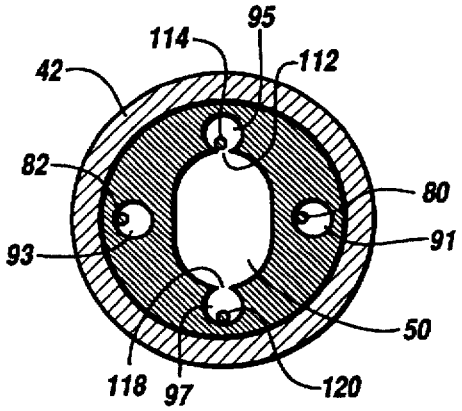
FIG. 5 is a cross-sectional view of the pump section in FIG. 4 taken along line 5—5.

Referring collectively to FIGS. 4A, 4B and 5, pump section 38 of automatic downhole intensifier 34 is depicted. As piston 48 oscillates axially within housing 42, fluid from interior volume 50 is pumped through exhaust valve 84, exhaust valve 86, intake valve 88 and intake valve 89 which are respectively disposed within bores 91, 93, 95, and 97 of housing 42. When piston 48 is traveling downward relative to housing 42, fluid from interior volume 50 enters chamber 72 through fluid passageway 120, intake valve 89 and fluid passageway 118. Fluid in chamber 73 is pumped through fluid passageway 82, exhaust valve 86 and fluid passageway 78 before exiting pump section 38.

Figure 6:
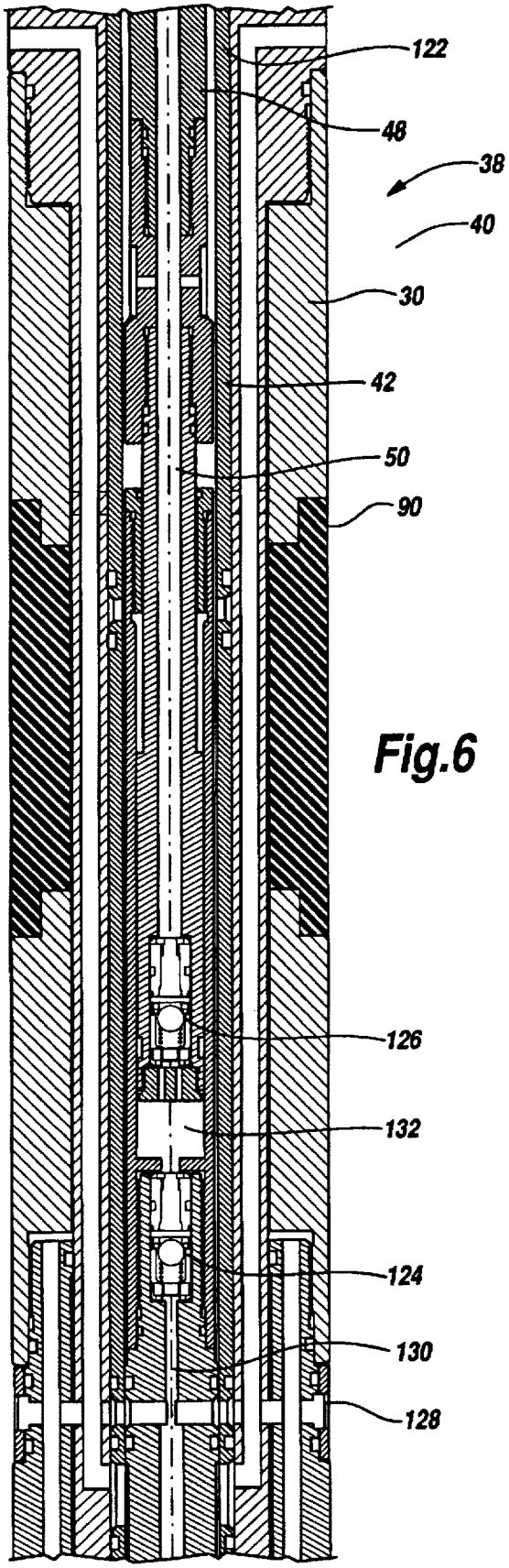
FIG. 6 is a half-sectional view of a pump section of an automatic downhole intensifier of the present invention.

As piston 48 travels upward relative to housing 42, fluid from interior volume 50 enters chamber 73 through fluid passageway 112, intake valve 88 and fluid passageway 114. Fluid in chamber 72 travels out of pump section 38 through fluid passageway 80, exhaust valve 84 and fluid passageway 76. In FIG. 6, an alternate embodiment of pump section 38 is depicted. Pump section 38 is inserted into drill string 30 or production tubing on probe 122 which comprises housing 42, piston 48, exhaust valve 124 and intake valve 126. As piston 48 travels upward relative to housing 42, fluid from interior volume 50 travels through intake valve 126 and into chamber 132. As piston 48 travels downward relative to housing 42, fluid from chamber 132 travels through exhaust valve 124 into fluid passageway 130, exhaust port 128 and into formation 14. It may be noted that pump section 38 may also be used to pump fluid into other downhole tools. This embodiment of pump section 38 may be used in conjunction with a power section 36 which is integral with drill string 30 as described in reference to FIG. 2A or with a probe mounted power section 36 as described in reference to FIG. 7 below.

Figure 7A:
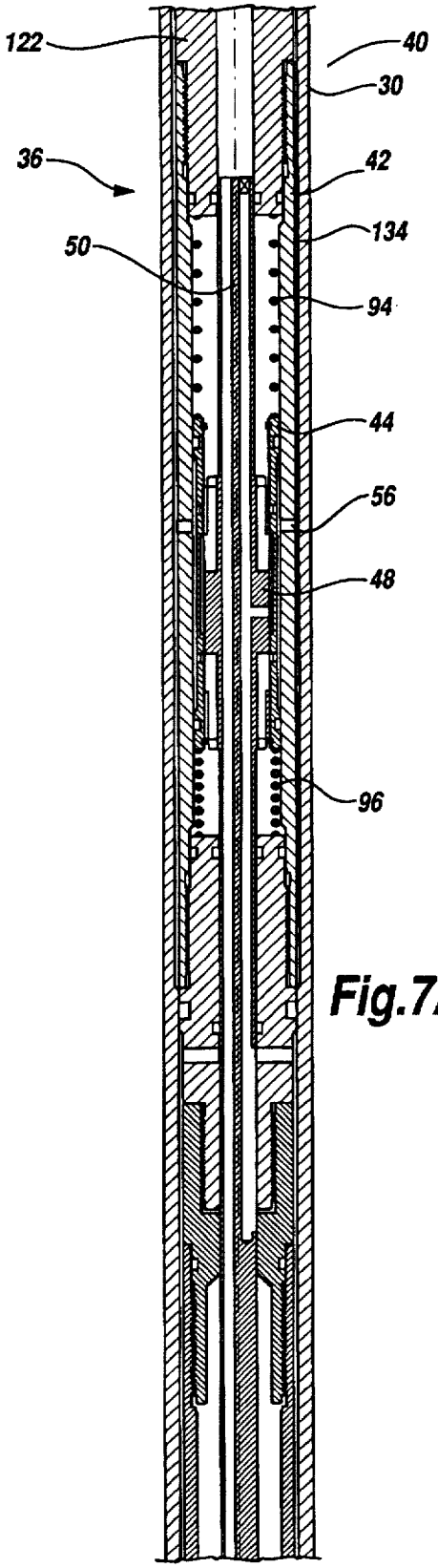
FIG. 7 is a half-sectional view of an automatic downhole intensifier of the present invention.
Figure 7B:
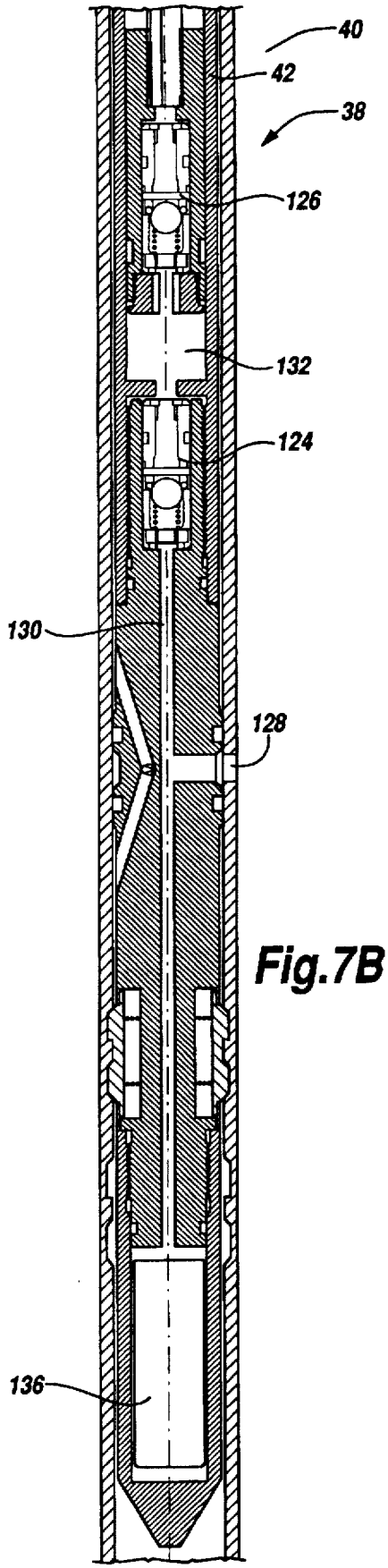

Referring to FIG. 7, a probe 122 mounted embodiment of automatic downhole intensifier 34 is depicted. Power section 36 includes housing 42, sleeve 44 slidably disposed within housing 42 and piston 48 slidably disposed within sleeve 44 and housing 42. Between pipe string 30 and housing 42 is annular chamber 134 which is in communication with fluid passageway 56 of housing 42. Annular chamber 134 provides an outlet for the fluid pumped into interior volume 50 during operation of power section 36.

In operation, pump section 36 of the probe 122 mounted embodiment of automatic downhole intensifier 34 internally oscillates as described in reference to FIGS. 3A–3E. Pump section 38 includes housing 42, piston 48, exhaust valve 124 and intake valve 126. As piston 48 travels upward relative to housing 42, fluid from interior volume 50 travels through intake valve 126 into chamber 132. As piston 48 travels downward relative to housing 42, fluid travels from chamber 132 through exhaust valve 124 into fluid passageway 130 and exits through exhaust port 128 into formation 14. The pressure of fluids entering exhaust port 128 may be measured by pressure recorder 136.

Figure 8:
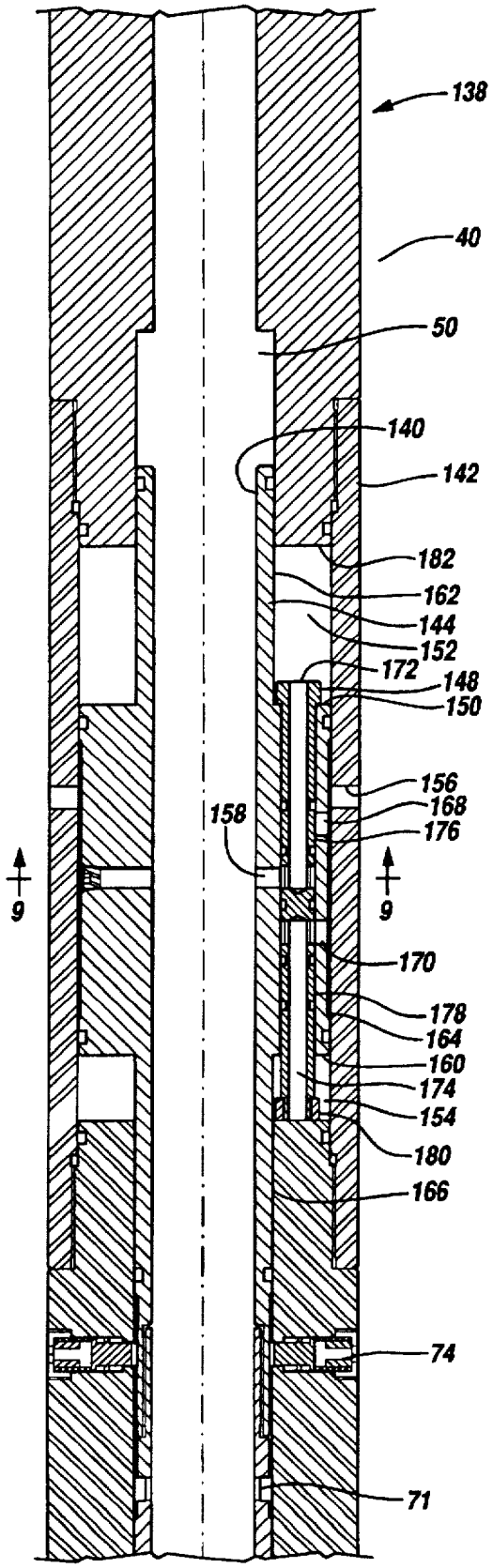
FIG. 8 is a half-sectional view of a power section of an automatic downhole intensifier of the present invention.
Figure 9:
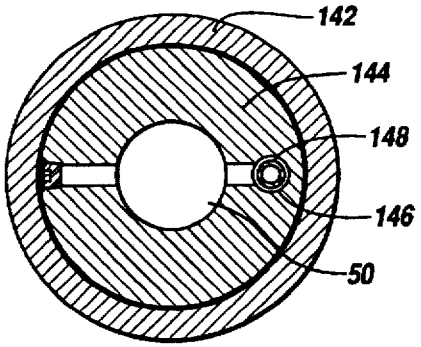
FIG. 9 is a cross-sectional view of the power section in FIG. 8 taken along line 9—9.

Referring next to FIGS. 8 and 9, an alternate embodiment of power section 138 of automatic downhole intensifier 34 is depicted. Power section 138 comprising housing 142 and mandrel 144 slidably disposed within housing 142, said mandrel 144 having inner cylindrical surface 140 defining interior volume 50. Mandrel 144 also defines hole 146 which extends between upper annular radially extending shoulder 150 and lower annual radially extending shoulder 160. Mandrel 144 has upper outer cylindrical surface 162 extending above shoulder 150, central outer cylindrical surface 164 extending between shoulder 150 and shoulder 160, and lower outer cylindrical surface 166 extending below shoulder 160. Between housing 142, shoulder 150 and surface 162 is upper chamber 152. Between housing 142, shoulder 160 and surface 166 is lower chamber 154.

Housing 142 defines fluid passageway 156 which is in communication with wellbore 40. Mandrel 144 defines fluid passageway 158 which is in communication with interior volume 50. Mandrel 144 also has upper fluid passageway 168 and lower fluid passageway 170 in communication with fluid passageway 156 of housing 142. Between piston 148 and mandrel 144 is upper volume 176 and lower volume 178.

In operation, upper fluid passageway 168 of mandrel 144 is alternately in communication with upper volume 176 and upper fluid passageway 172 of piston 148. Lower fluid passageway 170 of mandrel 144 is alternately in communication with lower volume 178 and lower fluid passageway 174 of piston 148. Fluid passageway 158 of mandrel 144 is alternately in communication with upper fluid passageway 172 and lower fluid passageway 174 of piston 148 as mandrel 144 oscillates relative to housing 142.

On the downward stroke of piston 148 and mandrel 144, fluid from interior volume 50 enters upper chamber 152 through fluid passageway 158 of mandrel 144 and upper fluid passageway 172 of piston 148 and fluid from lower chamber 154 exits into wellbore 40 through passageway 156 of housing 142, lower fluid passageway 170 of mandrel 144 and lower fluid passageway 174 of piston 148. Piston 148 travels downward until contact is made between piston 148 and shoulder 180 of housing 142. Mandrel 144 continues to travel downward until fluid passageway 158 of mandrel 144 is in communication with lower fluid passageway 174 of piston 148, upper fluid passageway 168 of mandrel 144 is in communication with upper fluid passageway 172 of piston 148 and lower fluid passageway 170 of mandrel 144 is in communication with lower volume 178.

On the upward stroke of piston 148 and mandrel 144, fluid from interior volume 50 enters lower chamber 154 through fluid passageway 158 of mandrel 144 and lower fluid passageway 174 of piston 148. While fluid from upper chamber 152 enters wellbore 40 through upper fluid passageway 172 of piston 148 and upper fluid passageway 168 of mandrel 144. Piston 148 travels upward until contact is made between piston 148 and shoulder 182 of housing 142. Mandrel 144 continues to travel upward until fluid passageway 158 of mandrel 144 is in communication with upper fluid passageway 172 of piston 148, upper fluid passageway 168 of mandrel 144 is in communication with upper volume 176 and lower fluid passageway 170 of mandrel 144 is in communication with lower fluid passageway 174 of piston 148. In addition, upper and lower coil springs (not pictured) may downwardly and upwardly bias piston 148, respectively.

Therefore, the apparatus and method for stimulating fluid production from subterranean formations disclosed herein have inherent advantages over the prior art. While certain embodiments of the invention have been illustrated for the purposes of this disclosure, numerous changes in the arrangement and construction of the parts may be made by those skilled in the art, such changes being embodied within the scope and spirit of the present invention as defined by the appended claims.

What is claimed is:

1. An apparatus for loading fluid into a subterranean formation comprising:

a power section; and a pump section operably associated with said power section so that said pump section is operated upon oscillatory motion of said power section after application of a fluid pressure to said power section, said pump section including a housing, at least one intake valve and at least one exhaust valve said housing of said pump section defining at least one fluid passageway in communication with an annular volume around the exterior of said housing of said pump section such that fluid is pumped from said pump section into said annular volume upon oscillatory motion of said power section.

2. The apparatus as recited in claim 1 wherein said power section further comprises:

a housing;

a sleeve slidably disposed within said housing of said power section; and a piston defining an interior volume, said piston slidably disposed within said sleeve and within said housing of said power section such that when said fluid pressure is applied to said interior volume, said sleeve oscillates relative to said housing of said power section and said piston oscillates relative to said sleeve and said housing of said power section.

3. The apparatus as recited in claim 2 wherein said sleeve oscillates axially relative to said housing of said power section.

4. The apparatus as recited in claim 2 wherein said sleeve oscillates rotatably relative to said housing of said power section.

5. The apparatus as recited in claim 2 wherein said piston oscillates axially relative to said sleeve and said housing of said power section.

6. The apparatus as recited in claim 2 wherein said piston oscillates rotatably relative to said sleeve and said housing of said power section.

7. The apparatus as recited in claim 2 wherein said piston and said housing of said power section define an upper chamber and a lower chamber therebetween.

8. The apparatus as recited in claim 7 wherein said housing of said power section has at least one fluid passageway in communication with an annular volume around the exterior of said housing of said power section, said sleeve has at least one fluid passageway which is in communication with said at least one fluid passageway of said housing of said power section and said piston has at least one upper radial fluid passageway in communication with said interior volume, at least one upper axial fluid passageway in communication with said upper chamber, at least one lower radial fluid passageway in communication with said interior volume, and at least one lower axial fluid passageway in communication with said lower chamber.

9. The apparatus as recited in claim 8 wherein said piston and said sleeve define an upper volume and a lower volume therebetween.

10. The apparatus as recited in claim 9 wherein said at least one upper radial fluid passageway is alternately in communication with said upper chamber and said upper volume, wherein said at least one upper axial fluid passageway is alternately in communication with said upper volume and said at least one fluid passageway of said sleeve, wherein said at least one lower radial fluid passageway is alternately in communication with said lower chamber and said lower volume, and wherein said at least one lower axial fluid passageway is alternately in communication with said lower volume and said at least one fluid passageway of said sleeve as said piston oscillates.

11. The apparatus as recited in claim 9 wherein fluid from said interior volume enters said upper chamber through said at least one upper radial fluid passageway and fluid from said lower chamber enters said annual volume through said at least one lower axial fluid passageway, said at least one fluid passageway of said sleeve, and said at least one fluid passageway of said housing of said power section, thereby urging said sleeve and said piston in a first direction relative to said housing of said power section.

12. The apparatus as recited in claim 9 wherein fluid from said interior volume enters said upper chamber through said at least one upper radial fluid passageway and fluid from said lower chamber enters said annular volume through said at least one lower axial fluid passageway, said at least one fluid passageway of said sleeve, and said at least one fluid passageway of said housing of said power section, thereby urging said piston in a first direction relative to said sleeve and said housing of said power section and placing said at least one upper radial fluid passageway in communication with said upper volume, said at least one upper axial fluid passageway in communication with at least one fluid passageway of said sleeve, said at least one lower radial fluid passageway in communication with said lower chamber, and said at least one lower axial fluid passageway in communication with said lower volume.

13. The apparatus as recited in claim 9 wherein fluid from said interior volume enters said lower chamber through said at least one lower radial fluid passageway and fluid from said upper chamber enters said annular volume through said at least one upper axial fluid passageway, said at least one fluid passageway of said sleeve, and said at least one fluid passageway of said housing of said power section, thereby upwardly urging said sleeve and said piston in a first direction relative to said housing of said power section.

14. The apparatus as recited in claim 9 wherein fluid from said interior volume enters said lower chamber through said at least one lower radial fluid passageway and fluid from said upper chamber enters said annular volume through said at least one upper axial fluid passageway, said at least one fluid passageway of said sleeve, and said at least one fluid passageway of said housing of said power section, thereby urging said piston in a first direction relative to said sleeve and said housing of said power section and placing said at least one upper radial fluid passageway in communication with said upper chamber, said at least one upper axial fluid passageway in communication with said upper volume, said at least one lower radial fluid passageway in communication with said lower volume, and said at least one lower axial fluid passageway in communication with said at least one fluid passageway of said sleeve.

15. The apparatus as recited in claim 2 further comprising an upper coil spring concentrically disposed within said housing of said power section biasing said sleeve in a first direction and a lower coil spring concentrically disposed within said housing of said power section biasing said sleeve in a second direction.

16. The apparatus as recited in claim 1 wherein said at least one intake valve and said at least one exhaust valve are check valves.

17. The apparatus as recited in claim 2 wherein said at least one intake valve oscillates with said piston and said at least one exhaust valve is fixed relative to said housing of said pump section and is in communication with said at least one fluid passageway such that fluid exits said pump section through said at least one fluid passageway when said piston moves in a first direction and fluid passes through said intake valve when said piston moves in a second direction.

18. The apparatus as recited in claim 2 wherein said piston and said housing of said pump section define a chamber therebetween, wherein said at least one fluid passageway of said pump section further includes first and second fluid passageways each in communication with said annular volume, wherein said at least one intake valve further includes first and second intake valves and wherein said at least one exhaust valve further includes first and second exhaust valves, said first and second exhaust valves respectively in communication with said first and second fluid passageways and said chamber, said first and second intake valves in communication with said chamber and said interior volume.

19. The apparatus as recited in claim 18 wherein fluid enters said chamber from said interior volume through said first intake valve and fluid exits said chamber through said first exhaust valve and said first fluid passageway as said piston travels in a first direction, and wherein fluid enters said chamber from said interior volume through said second intake valve and fluid exits said chamber through said second exhaust valve and said second fluid passageway as said piston travels in a second direction.

20. An apparatus for loading fluid into a subterranean formation comprising:

a power section including a housing, a mandrel slidably disposed within said housing of said power section, said mandrel defining an interior volume, said mandrel having at least one axially extending hole, and at least one piston slidably associated within said at least one axially extending hole such that when a fluid pressure is applied to said interior volume, said mandrel oscillates axially relative to said housing of said power section and said piston oscillates axially relative to said mandrel and said housing of said power section; and a pump section operably associated with said mandrel, said pump section including a housing, at least one intake valve and at least one exhaust valve, said housing of said pump section defining at least one fluid passageway in communication with an annular volume around the exterior of said housing of said pump section such that fluid is pumped from said pump section into said annular volume as said mandrel oscillates.

21. The apparatus as recited in claim 20 wherein said mandrel has upper and lower annular radially extending shoulders and an upper outer cylindrical surface extending axially upward from said upper annular radially extending shoulder, a central outer cylindrical surface axially extending between said upper annular radially extending shoulder and said lower annular radially extending shoulder and a lower outer cylindrical surface extending axially downward from said lower annular radially extending shoulder.

22. The apparatus as recited in claim 21 wherein said upper annular radially extending shoulder, said upper outer cylindrical surface of said mandrel and said housing of said power section define an upper chamber and wherein said lower annular radially extending shoulder, said lower outer cylindrical surface of said mandrel and said housing of said power section define a lower chamber.

23. The apparatus as recited in claim 22 wherein said at least one axially extending hole extends between said upper and lower annular radially extending shoulders.

24. The apparatus as recited in claim 23 wherein said housing of said power section has at least one fluid passageway in communication with an annular volume around the exterior of said housing of said power section, said mandrel has at least one inner fluid passageway which is in communication with said interior volume, said mandrel has at least one upper and lower outer fluid passageway in communication with said at least one fluid passageway of said housing of said power section and said piston has an upper fluid passageway in communication with said upper chamber and a lower fluid passageway in communication with said lower chamber.

25. The apparatus as recited in claim 24 wherein said piston and said mandrel define an upper volume and a lower volume therebetween.

26. The apparatus as recited in claim 25 wherein said at least one upper outer fluid passageway of said mandrel is alternately in communication with said upper volume and said upper fluid passageway of said piston, wherein said at least one lower outer fluid passageway of said mandrel is alternately in communication with said lower volume and said lower fluid passageway of said piston and wherein said inner fluid passageway of said mandrel is alternately in communication with said upper fluid passageway and said lower fluid passageway of said piston as said mandrel oscillates.

27. The apparatus as recited in claim 25 wherein fluid from said interior volume enters said upper chamber through said at least one inner fluid passageway of said mandrel and said upper fluid passageway of said piston and fluid from said lower chamber enters said annular volume through lower fluid passageway of said piston and said at least one lower outer fluid passageway of said mandrel, thereby urging said mandrel and said piston in a first direction relative to said housing of said power section.

28. The apparatus as recited in claim 25 wherein fluid from said interior volume enters said upper chamber through said at least one inner fluid passageway of said mandrel and said upper fluid passageway of said piston and fluid from said lower chamber enters said annular volume through said lower fluid passageway of said piston and said at least one lower outer fluid passageway of said mandrel, thereby urging said mandrel in a first direction relative to said piston and said housing of said power section and placing said at least one inner fluid passageway of said mandrel in communication with said lower fluid passageway of said piston, said at least one upper outer fluid passageway of said mandrel in communication with said upper fluid passageway of said piston, and said at least one lower outer fluid passageway of said mandrel in communication with said lower volume.

29. The apparatus as recited in claim 25 wherein fluid from said interior volume enters said lower chamber through said at least one inner fluid passageway of said mandrel and said lower fluid passageway of said piston and fluid from said upper chamber enters said annular volume through upper fluid passageway of said piston and said at least one upper outer fluid passageway of said mandrel, thereby urging said mandrel and said piston in a first direction relative to said housing of said power section.

30. The apparatus as recited in claim 25 wherein fluid from said interior volume enters said lower chamber through said at least one inner fluid passageway of said mandrel and said lower fluid passageway of said piston and fluid from said upper chamber enters said annular volume through upper fluid passageway of said piston and said at least one upper outer fluid passageway of said mandrel, thereby urging said mandrel in a first direction relative to said piston and said housing of said power section and placing said at least one inner fluid passageway of said mandrel in communication with said upper fluid passageway of said piston, said at least one upper outer fluid passageway of said mandrel in communication with said upper volume, and said at least one lower outer fluid passageway of said mandrel in communication with said lower fluid passageway of said piston.

31. The apparatus as recited in claim 20 further comprising an upper coil spring biasing said mandrel in a first direction and a lower coil spring biasing said mandrel in a second direction.

32. The apparatus as recited in claim 20 wherein said at least one intake valve oscillates with said mandrel and said at least one exhaust valve is fixed relative to said housing of said pump section, said at least one exhaust valve in communication with said at least one fluid passageway such that fluid exits said pump section through said at least one exhaust valve and said at least one fluid passageway when said mandrel moves in a first direction and fluid passes through said at least one intake valve when said mandrel moves in a second direction.

33. The apparatus as recited in claim 20 wherein said mandrel and said housing of said pump section define a chamber therebetween, wherein said at least one fluid passageway of said pump section includes first and second fluid passageways each in communication with said annular volume, wherein said at least one intake valve further includes first and second intake valves and wherein said at least one exhaust valve further includes first and second exhaust valves, said first and second exhaust valves respectively in communication with said first and second fluid passageways and said chamber, said first and second intake valves in communication with said chamber and said interior volume.

34. The apparatus as recited in claim 33 wherein fluid enters said chamber from said interior volume through said first intake valve and fluid exits said chamber through said first exhaust valve and said first fluid passageway as said mandrel travels in a first direction, and wherein fluid enters said chamber from said interior volume through said second intake valve and fluid exits said chamber through said second exhaust valve and said second fluid passageway as said mandrel travels in a second direction.

35. A method for loading fluid into a subterranean formation comprising the steps of:

placing an automatic downhole intensifier in a wellbore, said intensifier having a power section and a pump section operably associated with said power section;

applying a fluid pressure to said power section;

oscillating said power section;

operating said pump section as said power section oscillates; and pumping said fluid from said intensifier into the formation.

36. The method as recited in claim 35 further including the steps of reducing said fluid pressure applied to said power section to stop pumping said fluid from said intensifier into the formation.

37. The method as recited in claim 35 further including the step of setting a packer in said wellbore above the formation.

38. The method as recited in claim 37 further including the step of releasing said packer above the formation.

39. The method as recited in claim 37 further including the step of setting a packer in said wellbore below the formation.

40. The method as recited in claim 39 further including the step of releasing said packer below the formation.

* * * * *